US008371904B2

(12) United States Patent
Jindal et al.

(10) Patent No.: US 8,371,904 B2
(45) Date of Patent: Feb. 12, 2013

(54) POLISHING WITH ENHANCED UNIFORMITY

(75) Inventors: Sunil Kumar Jindal, Singapore (SG); Arun Kumar Gupta, Singapore (SG)

(73) Assignee: GLOBALFOUNDRIES Singapore Pte. Ltd., Singapore (SG)

( * ) Notice: Subject to any disclaimer, the term of this patent is extended or adjusted under 35 U.S.C. 154(b) by 1063 days.

(21) Appl. No.: 12/188,226

(22) Filed: Aug. 8, 2008

(65) Prior Publication Data

US 2010/0035527 A1 Feb. 11, 2010

(51) Int. Cl.
*B24B 7/22* (2006.01)

(52) U.S. Cl. ..... 451/41; 451/388

(58) Field of Classification Search ..... 451/41, 451/388, 398, 287, 288, 289
See application file for complete search history.

(56) References Cited

U.S. PATENT DOCUMENTS

| | | | | |
|---|---|---|---|---|
| 5,605,488 | A * | 2/1997 | Ohashi et al. | 451/7 |
| 5,762,539 | A * | 6/1998 | Nakashiba et al. | 451/286 |
| 6,135,858 | A * | 10/2000 | Takahashi | 451/41 |
| 6,390,905 | B1 * | 5/2002 | Korovin et al. | 451/286 |
| 6,998,013 | B2 | 2/2006 | Jan et al. | |
| 7,402,098 | B2 * | 7/2008 | Severson et al. | 451/288 |
| 2004/0102144 | A1 * | 5/2004 | Brown | 451/288 |

* cited by examiner

*Primary Examiner* — Robert Rose
(74) *Attorney, Agent, or Firm* — Horizon IP Pte Ltd

(57) ABSTRACT

A polishing head is presented. The polishing head includes a housing having top and bottom surfaces. The housing is formed from a single piece of material. The polishing head includes grooves disposed on the bottom surface and an inlet in communication with the grooves for coupling to a pressure medium supply to supply a pressure medium to the grooves. The pressure medium when supplied to the grooves exerts pressure on a template when attached to the bottom surface to provide back side pressure on a back surface of an article when temporally attached to the template.

17 Claims, 8 Drawing Sheets

328

POLISHING WITH ENHANCED UNIFORMITY

BACKGROUND

The fabrication of ICs involves the formation of features on a substrate that make up circuit components, such as transistors, resistors and capacitors. The devices are interconnected, enabling the ICs to perform the desired functions. An important aspect of the manufacturing of ICs is the need to provide planar surfaces using planarization techniques.

To planarize substrates, chemical mechanical polishing (CMP) can be used. CMP tools generally include a platen with a polishing pad. A wafer carrier including a polishing head is provided. The polishing head holds the wafer so that the surface of the wafer to be polished faces the polishing pad. During polishing, the polishing head presses the wafer surface against a rotating polishing pad. Slurry which consists of small abrasive particles is provided between the wafer surface and the pad. The polishing head may also rotate and oscillate the wafer as it is being polished.

However, we have observed that non-uniformity can occur across the wafer with the use of conventional polishing heads. Such non-uniformity can lead to processing issues as well as negatively impacting yields.

From the foregoing discussion, it is therefore desirable to provide polishing heads with improved uniformity.

SUMMARY

A polishing head is disclosed. The polishing head includes a housing having a top and bottom surface. The housing is formed from a single piece of material. Grooves are disposed on the bottom surface. The polishing head includes an inlet in communication with the grooves for coupling to a pressure medium supply to supply a pressure medium to the grooves. The pressure medium when supplied to the grooves exerts pressure on a template when attached to the bottom surface to provide back side pressure on a back surface of an article when temporally attached to the template.

In another embodiment, the polishing head further includes a plurality of grooves to provide a plurality of independently controlled pressure zones and a mounting unit for attaching template to the bottom of the housing. The template covers the grooves and provides a mating surface on which an article to the polished is temporally attached for polishing.

A method of fabricating a semiconductor device is disclosed. The method includes providing a substrate prepared with a device layer for polishing. A pressure profile is set in a polishing head formed from a single piece of material. The substrate is polished based on the pressure profile. In another embodiment, the method includes setting the pressure profile in a polishing head that includes a plurality of independently controllable pressure zones.

These and other objects, along with advantages and features of the present invention herein disclosed, will become apparent through reference to the following description and the accompanying drawings. Furthermore, it is to be understood that the features of the various embodiments described herein are not mutually exclusive and can exist in various combinations and permutations.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention. Various embodiments of the present invention are described with reference to the following drawings, in which.

DETAILED DESCRIPTION

Embodiments relates to polishing to provide a planar surface on, for example, a wafer surface. Although embodiments are described in the context of semiconductor manufacturing, it can be applied to other industries of applications.

Figure 1A:
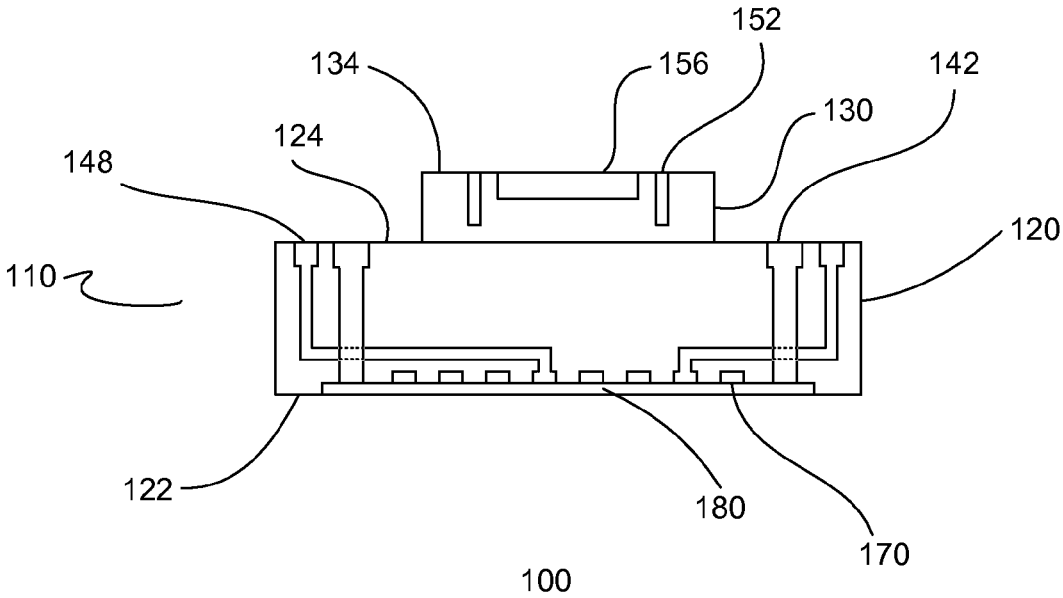
FIGS. 1*a-c* shows cross-sectional, top and bottom views of an embodiment of a polishing head.
Figure 1B:
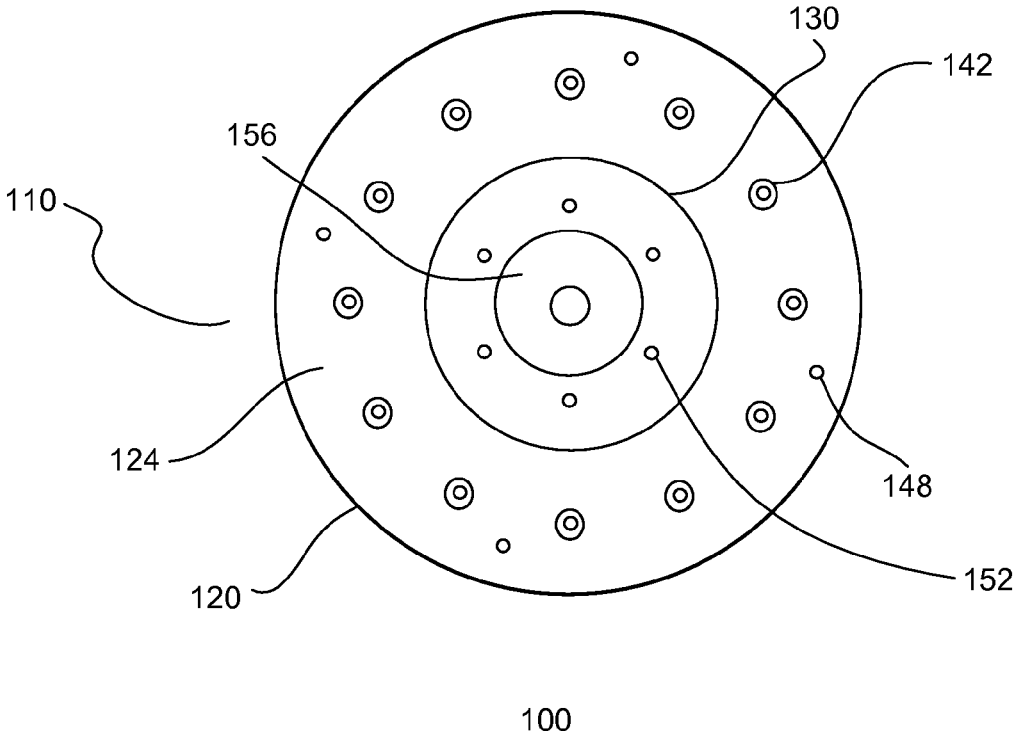
Figure 1C:
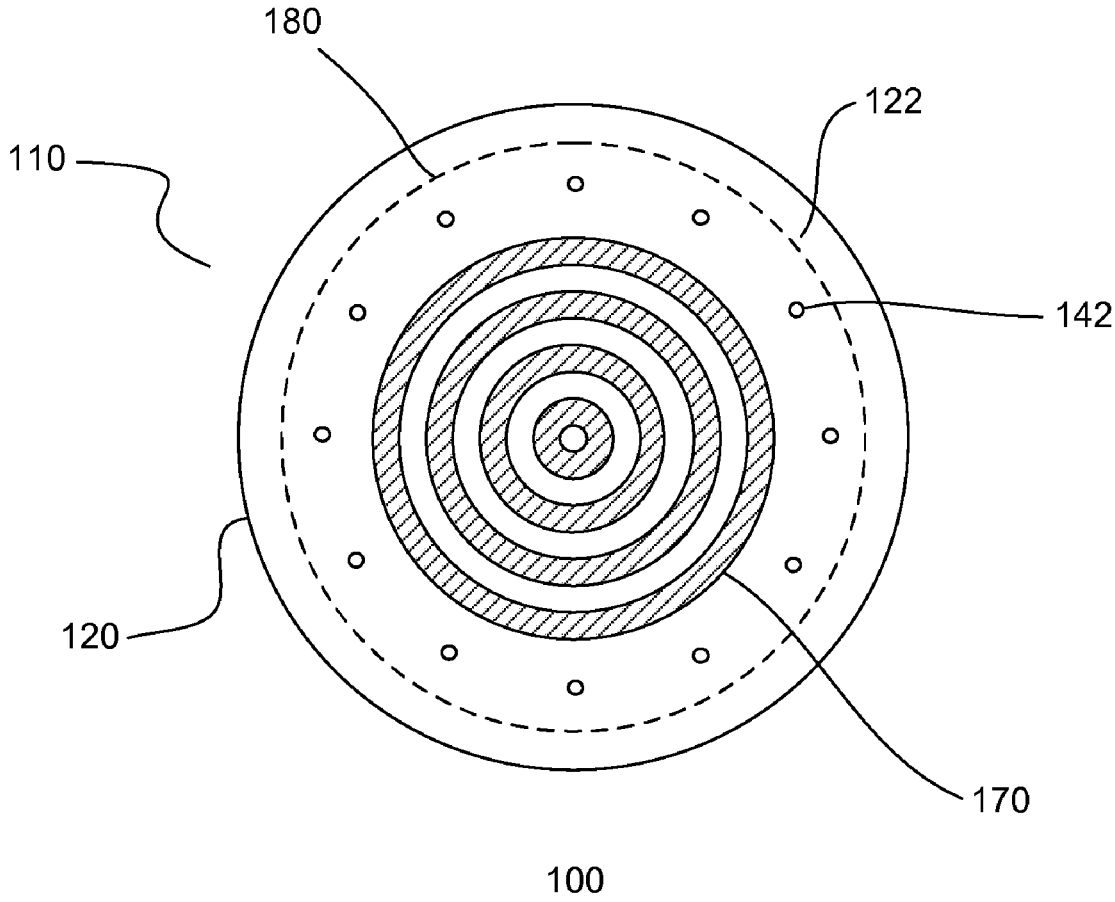

FIGS. 1*a-c* show cross-sectional, top and bottom views of a polishing head 100 in accordance with one embodiment. The polishing head can be mounted on a carrier arm of a polishing tool. For example, the polishing arm can be rotated or moved to position the polishing head for loading and polishing of an article, such as a semiconductor wafer. Polishing of other types of articles is also useful. As shown, the polishing head comprises a housing 110 having a base unit 120 and mount unit 130. Exemplary dimensions (in millimeters) of the polishing head are provided. The dimensions, for example, correlates to a polishing head for a 200 mm wafer. Other dimensions are also useful.

In a preferred embodiment, base and mount units are formed from a single piece of material. The polishing head, for example, comprises high grade stainless steel. Other types of materials can also be used to form the polishing head. The polishing head can be formed by various machining techniques, such as milling, turning and/or drilling. Other techniques, for example, welding or molding can also be useful. The use of a single unit polishing head design advantageously avoids the need for o rings and vacuum seals, as required in conventional polishing head designs. Providing multi-piece of material for polishing heads is also useful.

The mount unit is mated to a carrier arm of a polishing system. The polishing, for example, can include a CMP or eCMP system. CMP or eCMP systems can be those manufactured by Applied Materials, Inc., Ebara or other manufacturers. Other types of polishing systems are also useful. The carrier arm is used to position the polishing head for loading and polishing of an article such as a semiconductor wafer. Polishing other types of articles is also useful. The carrier arm can also rotate and/or oscillate the polishing head during wafer polishing.

To mate the polishing head to the carrier, a plurality of mating holes 152 are provided in the mounting unit. The mating holes are disposed on a top surface 134 of the mount unit and extend downwards. The depth should be sufficient to house a fastener used for attaching the mount unit to the carrier arm. For example, the depth of the holes is about 15 mm with a diameter which fits the M6 size fasteners. Other depths or diameters are also useful.

As shown, six mating holes are provided. The mating holes comprise an annular arrangement, being equidistance apart. Other mating hole configurations, including diameter size, depth and arrangement, are also useful. The holes, for example, are configured to mate to a specific carrier type. To mate the polishing head to different carrier types, an adaptor (not shown) can be employed. For example, an adaptor can be disposed between the polishing head and carrier. This increases flexibility by enabling the polishing head to be used on different types of polishing tools.

In one embodiment, the mount unit includes a recess 156. The recess, for example, can serve to align an adaptor used for mounting the polishing head to the carrier.

The base unit comprises bottom and top surfaces 122 and 124. The base unit includes through holes 142 which extend from the top to the bottom surfaces. The through holes houses fasteners, such as bolts. Other types of fasteners are also useful. In one embodiment, the through hole comprises a larger diameter at the upper portion than the lower portion, forming a step. The step serves to fit the head of a fastener, such as a M4 size bolt. For example, the upper portion has a diameter of about 7.5 mm and a depth of about 5.5 mm while diameter of the lower portion is about 4.5 mm. As shown, twelve through holes are provided. The through holes comprise an annular arrangement being equidistance apart. Other through hole configurations, including diameter size, depth and arrangement, are also useful.

In one embodiment, a template 180 is mounted onto the bottom of the base unit. The template can comprise an annular shape. Other shapes are also useful. The template serves as a mounting surface for a wafer to be polished. The template, for example, comprises a rigid outer frame. The frame supports a pliable inner portion. The rigid support frame can comprise a rigid material (e.g., polyphenylene sulfide (PPS)) while the inner portion comprises a flexible material (e.g., ethylene propylene diene monomer (EPDM) or rubber). Other types of materials for the support frame and inner portions are also useful.

To hold the wafer, at least one mounting opening is provided on the template. The mounting opening is coupled to, for example, pressure source. The pressure source, in one embodiment, produces vacuum pressure to hold the wafer against the template. A plurality of mounting openings can be provided. The pattern and number of openings can depend on design requirements. In one embodiment, a guard ring can be provided on the template to prevent slippage of the wafer. The guard ring, for example, comprises a rigid material such as PPS. Other materials can be used to form the guard ring.

In one embodiment, the bottom surface comprises a recess in a central portion. The recess, for example, accommodates the template. For example, the recess comprises an annular shape to accommodate the annular shaped template. Other shapes are also useful. Furthermore, it is understood that the recess and template can have different shapes. In one embodiment, the recess is designed to enable the bottom surface (wafer mating surface) of the template to be flushed with the bottom surface of the base unit when mounted. To retain the template in place, fasteners are inserted into the through holes from the top of the base unit and mated to the template. In one embodiment, twelve fasteners can be provided and located equi-distanced apart. The fasteners, for example, comprise M6 fasteners. Other numbers, types or configurations of fasteners are also useful.

Grooves or channels 170 are provided in the recess in the bottom of the base unit. The grooves are in communication with the template. Supply inlets 148 are provided, in one embodiment on the top of the base unit. Locating the supply inlets in other parts of the polishing head is also useful. Inlet channels couple the inlets with the grooves. In one embodiment, four supply inlets are provided. As shown, the supply inlets comprise an annular arrangement being equal distanced apart on the top surface of the base unit. Other supply inlet configurations, including number of supply inlets and arrangements are also useful.

The supply inlets are coupled to a pressure medium. In one embodiment, the pressure medium comprises nitrogen. Other types of pressure medium, such as CDA, inert gases, or a combination thereof, may also be useful for other CMP processes. The pressure medium is used to control the pressure applied to the back of the template, thereby imparting pressure on the backside of the substrate.

In one embodiment, a pressure controller (not shown) is provided to control the flow of pressure medium. By controlling the flow rate of the pressure medium, the wafer profile can be controlled. The pressure controller can include valve control and pressure sensors, for example, to monitor and control the flow rate to achieve the desired pressure profile. Polishing head down force is applied by polishing arm during polishing. For example, increasing the gas supply to the grooves causes an increase in back side pressure on the wafer, hence controls wafer profile. For example, the greater the down force, the greater the polishing rate.

The pattern of grooves on the base unit should be sufficient to provide adequate down force (back side pressure) on the wafer. Various grooves type patterns can be useful. In one embodiment, the groove pattern forms a plurality of independently controlled pressure zones. Independent zones are provided with a plurality of distinct grooves, with one zone corresponding to one groove.

As shown in FIG. 1*c*, the recess comprises a plurality of distinct concentric annular grooves. The grooves, for example, are equidistantly spaced apart from each other. The recess, for example, comprises 4 concentric annular grooves to provide 4 independently concentric zones. The dimensions of the grooves, for example, can be about 4-5 mm wide and 3-4 mm deep. Other groove dimensions are also useful.

The number of independent grooves corresponds to the number of pressure zones while the distance between the grooves defines the distance between corresponding pressure zones. Although as shown, the grooves are configured as four independent concentric grooves, other number of grooves or groove patterns can also be used, for example, to form other number of or shaped pressure zones. The groove pattern and distance of the grooves can be selected to match the desired granularity. For example, the pattern can be configured to have more closely spaced apart grooves for finer control of pressure profile. The desired granularity can depend on, for example, the profile of the incoming wafer. Different deposition tools can have characteristics which create different wafer profiles. The grooves can be configured to accommodate the profiles to produce a planar surface.

In one embodiment, at least one inlet is provided for each independent groove to supply the pressure medium. Providing a groove with more than one inlet is also useful.

By providing a plurality of independently controlled pressure zones, the desired pressure profile can be tailored to produce uniform polishing rate across the wafer. For example, the pressure profile can be tailored to compensate for the difference in angular velocity between the outer and inner portions of the wafer. For example, more pressure can be applied to the inner portions of the wafer than the outer portions since the inner portions have a slower angular velocity than the outer portions. Furthermore, the pressure profile can be tailored to optimize yields for specific products. For example, the pressure profile can be tailored depending on die size, pattern density, or other wafer characteristics.

Figure 2:
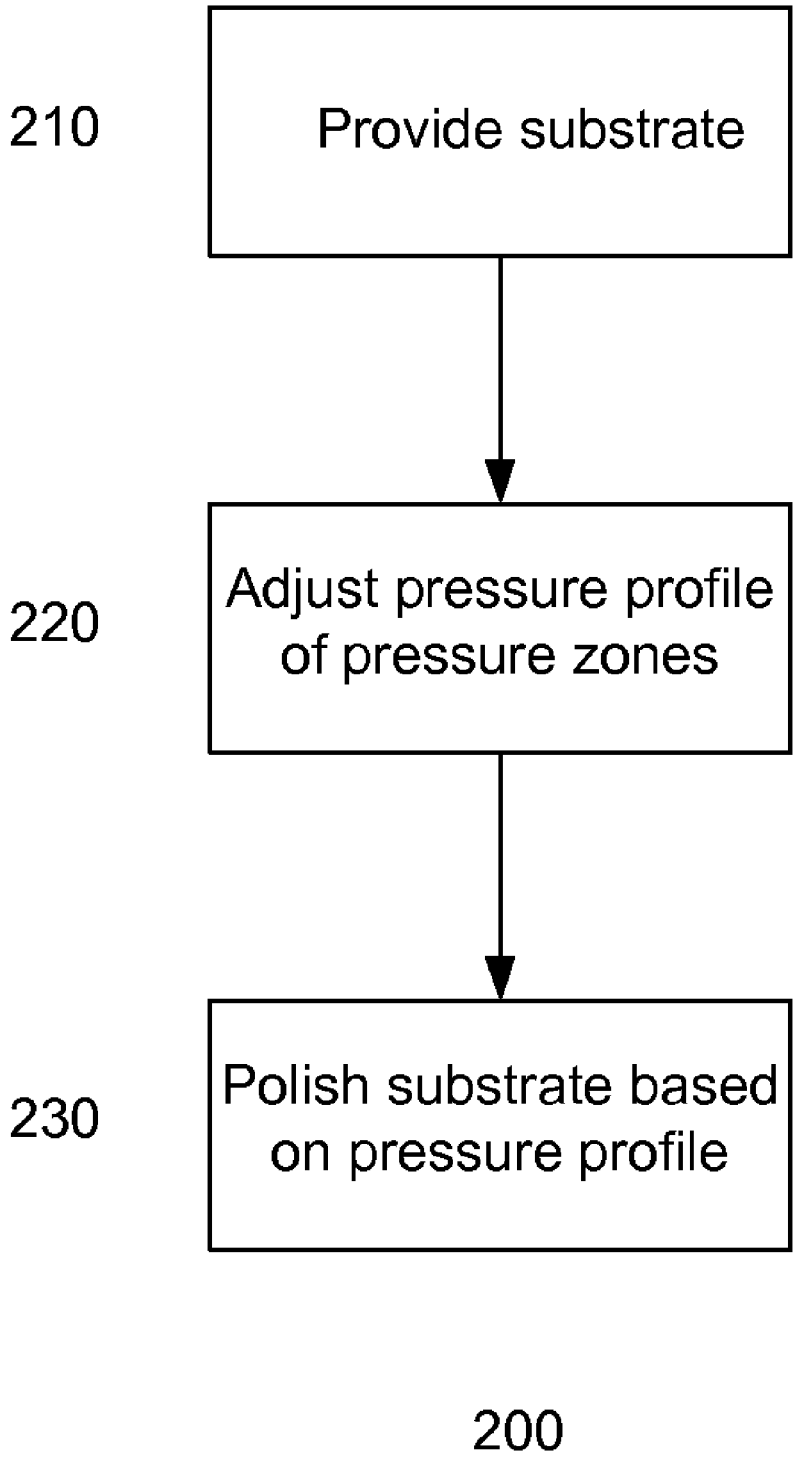
FIG. 2 shows an embodiment of a process for fabricating a wafer.

FIG. 2 shows a process 200 for fabricating a wafer in accordance with one embodiment of the invention. As shown, a wafer which has been prepared for polishing is provided at step 210. The wafer, for example, is prepared with a dielectric layer which requires polishing. Alternatively, the wafer can be prepared with a conductive material filling vias or filling trenches for which polishing is required to form contacts or interconnects. At step 220, the pressure profile of the plurality of pressure zones are defined. The wafer is then polished according to the pressure profile at step 230. The ability to tailor the pressure profile, for example, can result in a more uniform polishing rate across the wafer.

Figure 3A:
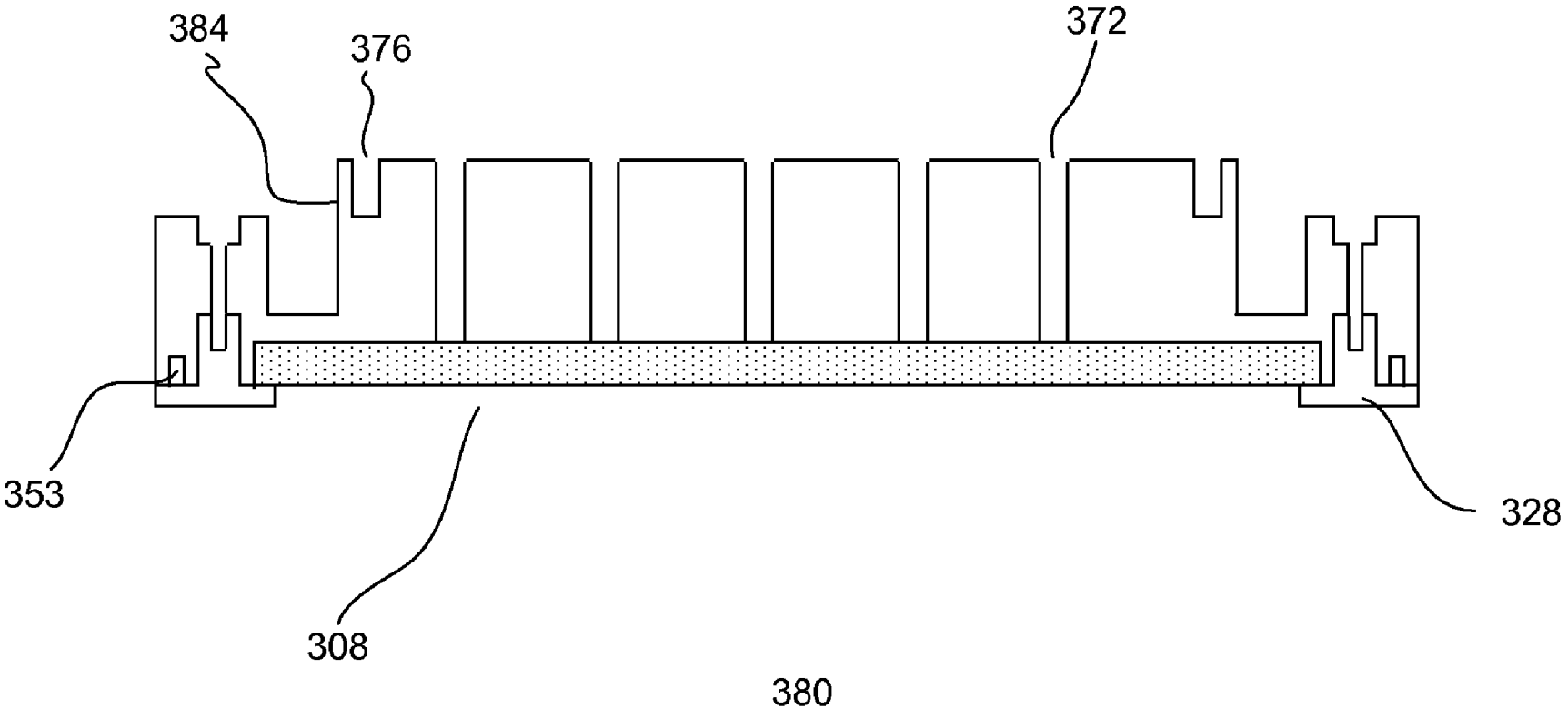
FIGS. 3*a-d* show an embodiment of a template, a template support frame, a guide ring and a mounting pad.
Figure 3B:
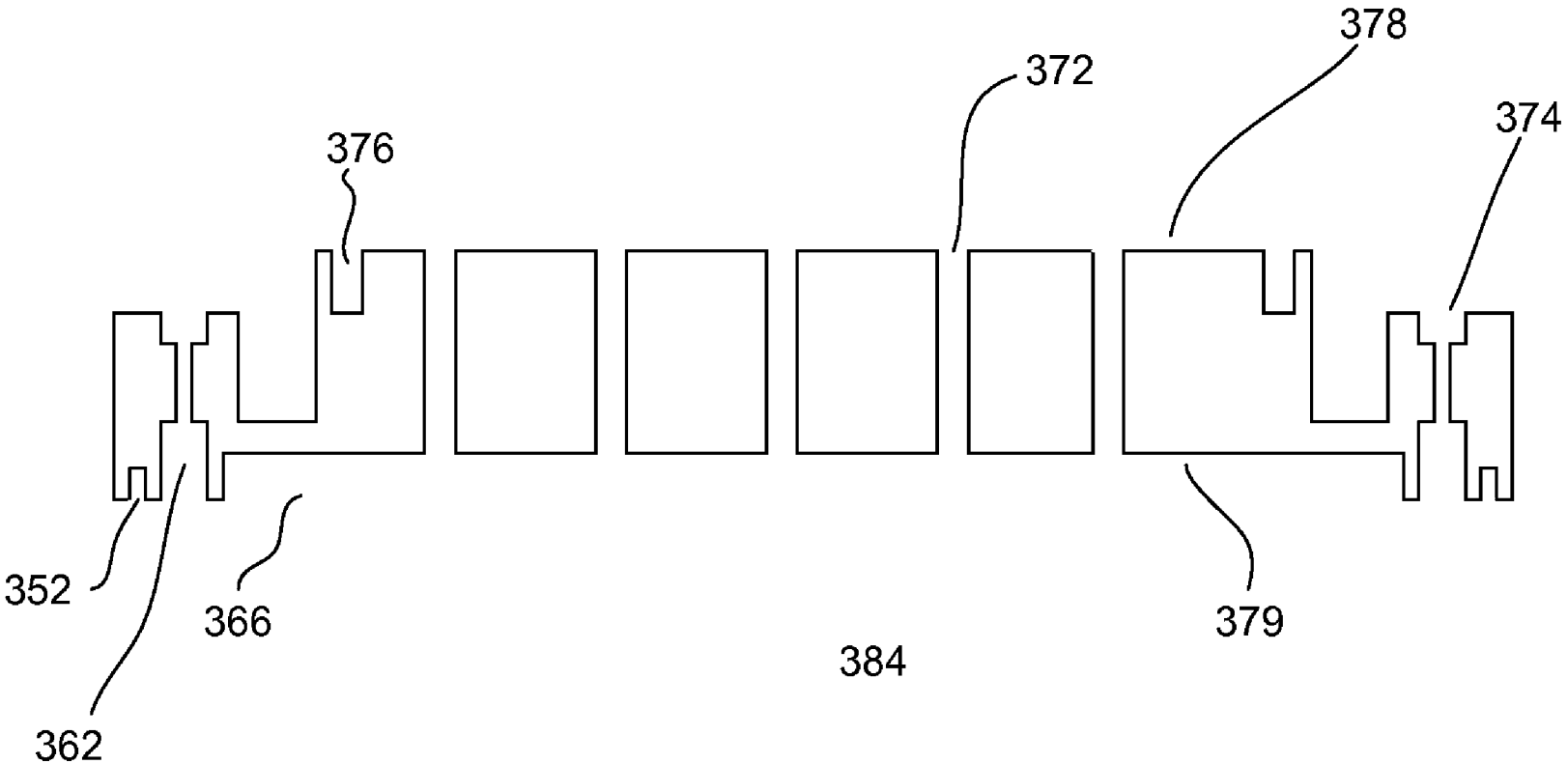
Figure 3C:
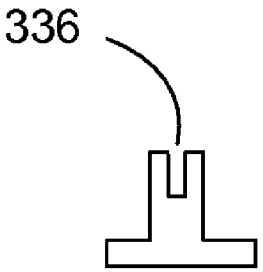
Figure 3C:
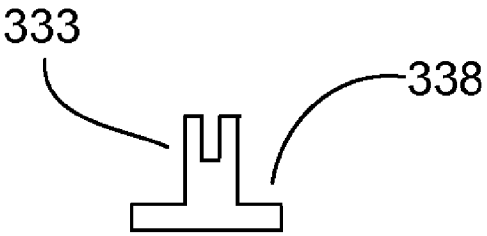
Figure 3D:
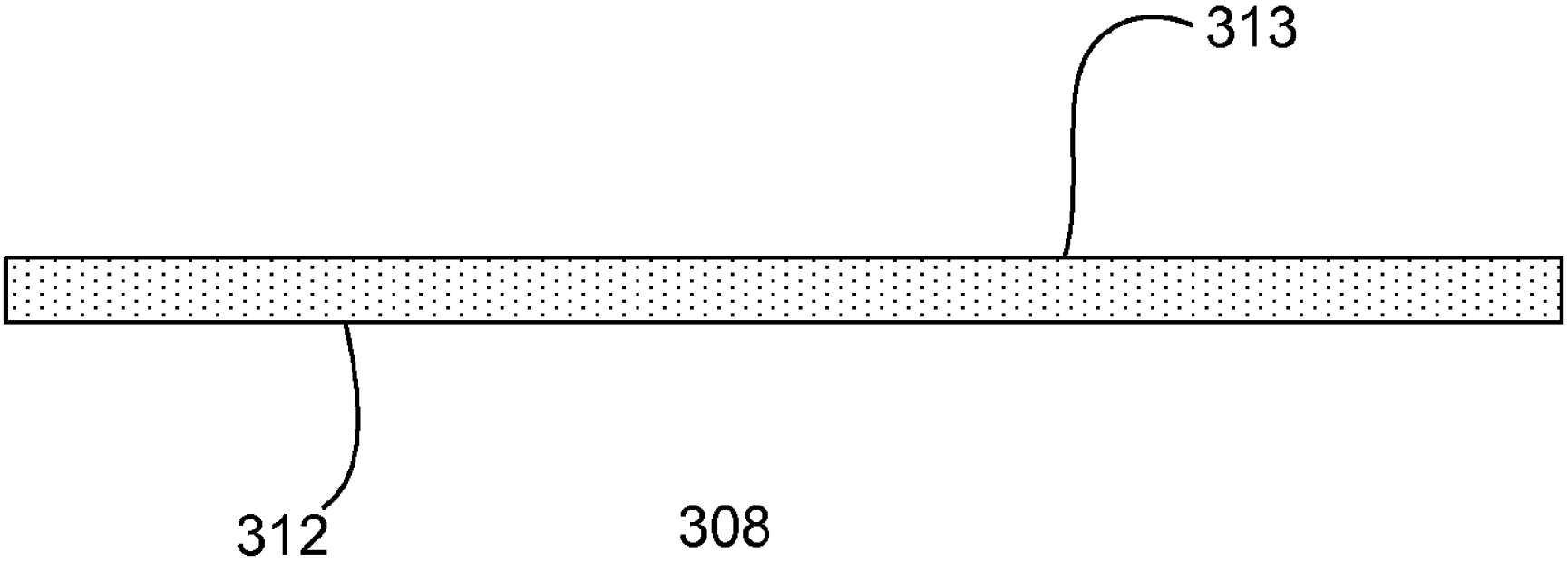

FIG. 3*a* shows an embodiment of a template 380. In one embodiment, the template comprises a template assembly which includes a template support frame 384, a guide ring 328 and a mounting pad 308. FIG. 3*b* shows the template support frame; FIG. 3*c* shows the guide ring and FIG. 3*d* shows the mounting pad 308. Referring to the FIGS. 3*a* and 3*b*, the template support frame is formed from a rigid material. Preferably, the rigid material is resistant to chemicals used in polishing, such as DIW. In one embodiment the support frame is formed from PPS. Other types of materials are also useful. A plurality of through holes 372 are provided on the support frame. The through slots are aligned to the supply holes on the polishing head.

The template support frame includes top and bottom surfaces 379 and 378. The top surface is mated to the polishing head. The topography of the top surface can be designed to mate to the polishing head. Fastening holes 376 are provided on the top surface to facilitate fixing the template assembly to the polishing head. The fastening holes, for example, comprise threaded holes. Other types of fastening holes are also useful. For example, a fastener such as a bolt on the polishing head can be treaded to the fastening holes to fix the template assembly to the polishing head. The fastening holes can be distributed over near the circumference of the template. For example, the template can be provided with twelve fastening holes. Providing other numbers of fastening holes is also useful.

Assembly fastening holes 374 are also provided on the support frame. The assembly fastening holes facilitate for assembly of the different components of the template assembly. In one embodiment, the assembly fastening holes comprise countersink through holes. Other types of assembly fastening holes are also useful. The assembly fastening holes can be distributed over template near edge or circumference. In one embodiment, the assembly fastening holes are located outside of the fastening holes. For example, the template can be provided with twelve fastening holes. Providing other numbers of fastening holes is also useful.

The bottom surface of the template support frame comprises a recess 366. The recess accommodates the mounting pad. A guide ring groove 362 is provided on the bottom surface of the template support frame. The guide ring groove is aligned with the assembly fastening holes. The guide ring groove holds the guide ring in position. An o-ring groove 352 can be provided on the bottom surface of the template support frame. The o-ring groove is located near the circumference of the bottom surface of the template support frame. In one embodiment, the o-ring groove is disposed outside of the guide ring groove. An o-ring 353 is disposed in the o-ring groove to provide sealing between the support frame and guide ring.

The guide ring comprises a post 333 disposed on a base 338. The guide ring comprises a rigid material. Preferably, the rigid material is resistant to chemicals used in polishing, such as DIW. In one embodiment, the guide ring is formed from PPS. Other types of materials are also useful. The post and base, for example are annular. The post includes ring fastening holes 336. In one embodiment, the ring fastening holes comprise threaded holes. The post fits into the slots in the bottom of the assembly fastening holes of the template support frame. For example, to fix the guide ring to the support fame, a fastener such as a bolt can be inserted through the assembly fastening holes and threaded to the ring fastening holes. The base of the guide ring forms a step to support the mounting pad.

The mounting pad 308, which forms an inner portion of the template assembly, comprises a flexible material. In one embodiment, the mounting pad comprises EPDM. Other types of flexible or pliable materials are also useful. The mounting pad comprises bottom and top surfaces 312 and 313. The top surface is mated to the support frame. The bottom surface provides a mounting surface, for example, for the wafer. In one embodiment, the mounting pad comprises a plurality of openings. The openings, for example serve to supply vacuum pressure to hold the wafer in place during polishing. Providing additional openings to supply back side pressure can also be useful. The openings and types of pressure can be distributed based on processing and/or design requirements.

Figure 3E:
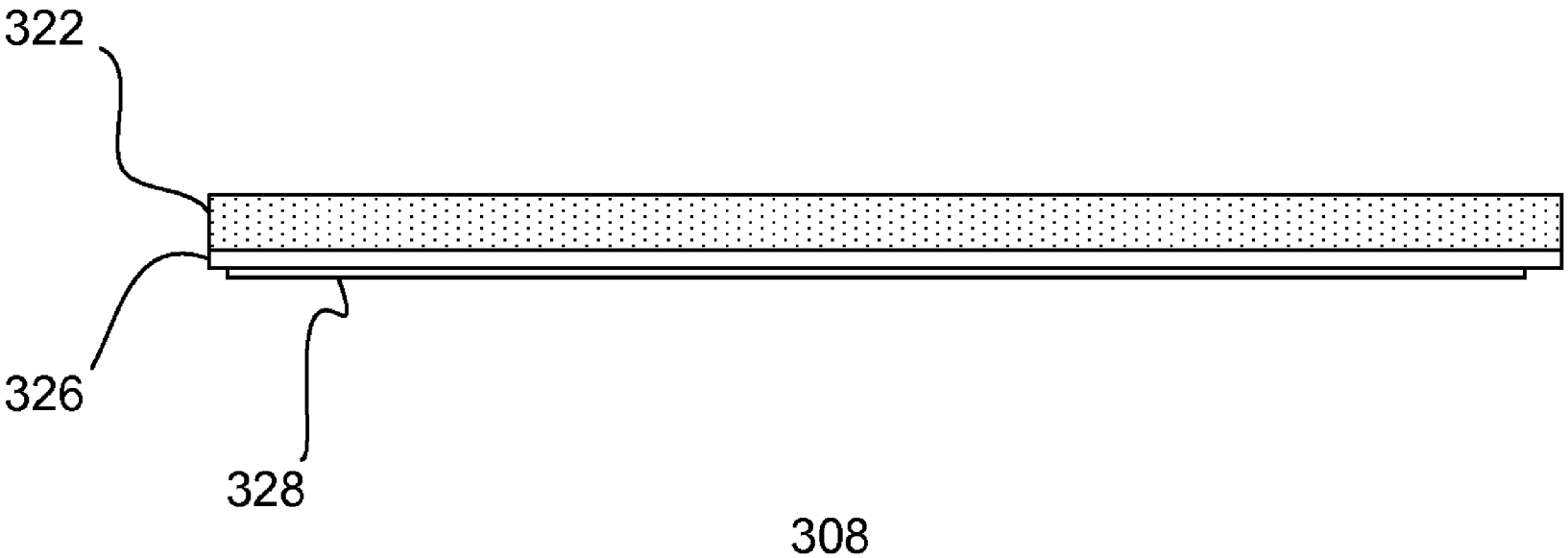
FIG. 3*e* shows an alternative embodiment of a mounting pad.

FIG. 3*e* shows another embodiment of a mounting pad 308. The mounting pad comprises a pad 322, a pad base 326 and a backing film 328. The pad and backing film are attached on opposing major surfaces of the pad base. In one embodiment, an adhesive, such as glue or paste, is used to attach the pad and backing film to the pad base. Other techniques for attaching the pad and backing film are also useful. In one embodiment, the pad comprises a flexible material such as EPDM and the pad base comprises a rigid material, such as plastic. Other types of materials are also useful. The backing film provides a mating surface on which the wafer is mounted. In one embodiment, the mounting pad comprises a plurality of openings. The openings, for example serve to supply vacuum pressure to hold the wafer in place during polishing. Providing additional openings to supply back side pressure to the wafer can also be useful. The openings and types of pressure can be distributed based on processing and/or design requirements.

The above invention may be embodied in other specific forms without departing from the spirit or essential characteristics thereof. The foregoing embodiments, therefore, are to be considered in all respects illustrative rather than limiting the invention described herein. The scope of the invention is thus indicated by the appended claims, rather than by the foregoing description, and all changes that come within the meaning and range of equivalency of the claims are intended to be embraced therein.

What is claimed is:

1. A polishing head comprising:

a housing having a top surface and a bottom surface, wherein the housing is formed from a single piece of material;

concentric continuous annular grooves disposed on the bottom surface of the housing, wherein the concentric continuous annular grooves comprise independent concentric continuous annular grooves;

a template disposed on the bottom surface of the housing, wherein the template is configured to contact a wafer to be polished when temporally attached to the template to prevent slippage of the wafer; and an inlet in communication with the grooves for coupling to a pressure medium supply to supply a pressure medium to the grooves, the pressure medium when supplied to the grooves exerts pressure on the template to provide back side pressure on a back surface of the wafer when temporally attached to the template.

2. The polishing head of claim 1 wherein:

the independent concentric continuous annular grooves form independent concentric continuous annular pressure zones on the template; and an independent groove comprises at least one pressure supply inlet.

3. The polishing head of claim 1 comprises a mounting unit for attaching a template to the bottom of the housing, wherein the template covers the grooves, the template provides a mating surface on which the wafer to be polished is temporally attached for polishing.

4. The polishing head of claim 3 wherein an independent groove comprises at least one pressure supply inlet.

5. The polishing head of claim 3 wherein the mounting unit is disposed in a recess for accommodating the template, wherein the grooves are disposed in the recess.

6. The polishing head of claim 5 wherein an independent groove comprises at least one pressure supply inlet.

7. The polishing head of claim 1 comprises stainless steel.

8. The polishing head of claim 7 wherein an independent groove comprises at least one pressure supply inlet.

9. The polishing head of claim 1 wherein the template covers the grooves, the template provides a mating surface on which an article to be polished is temporally attached for polishing.

10. The polishing head of claim 9 wherein an independent groove comprises at least one pressure supply inlet.

11. The polishing head of claim 1 wherein the housing comprises:

a mounting unit having a top mounting unit surface which forms the top surface of the housing, the top surface is configured to attach the polishing head to a carrier of a polishing system; and a base unit having a base unit bottom surface which forms the bottom surface of the housing, the bottom surface comprises a recess to accommodate the template, wherein the grooves are disposed in the recess.

12. The polishing head of claim 11 wherein an independent groove comprises at least one pressure supply inlet.

13. The polishing head of claim 12 wherein flow rate of pressure media is controlled to produce the desired pressure profile for polishing the wafer.

14. A polishing head comprising:

a head housing having a top surface and a bottom surface, wherein the housing is formed from a single piece of material;

a plurality of independent concentric continuous annular grooves disposed on the bottom surface of the housing to provide a plurality of independently controlled concentric continuous annular pressure zones;

a template disposed on the bottom surface of the housing, wherein the template covers the grooves, the template is configured to contact a wafer to be polished when temporally attached to the template to prevent slippage of the wafer; and inlets in communication with the grooves for coupling to a pressure medium supply to supply a pressure medium to the plurality of grooves to independently control the pressure exerted in the pressure zones during polishing when the wafer is temporally attached to the template.

15. A method of fabricating a semiconductor device comprising:

providing a substrate prepared with a device layer for polishing;

setting a pressure profile in a polishing head, wherein the polishing head comprising a housing having a top surface and a bottom surface, wherein the housing is formed from a single piece of material, concentric continuous annular grooves disposed on the bottom surface of the housing, wherein the concentric annular grooves comprise independent concentric continuous annular grooves, a template disposed on the bottom surface of the housing, wherein the template is configured to contact the substrate when temporally attached to the template to prevent slippage of the substrate, and an inlet in communication with the grooves for coupling to a pressure medium supply to supply a pressure medium to the grooves, the pressure medium when supplied to the grooves exerts pressure on the template to provide back side pressure on a back surface of the substrate when temporally attached to the template; and polishing the substrate based on the pressure profile.

16. A method of fabricating a semiconductor device comprising:

providing a substrate prepared with a device layer for polishing;

setting a pressure profile in a polishing head which includes a plurality of independently controllable pressure zones, wherein the polishing head comprising a housing having a top surface and a bottom surface, wherein the housing is formed from a single piece of material, concentric continuous annular grooves disposed on the bottom surface of the housing, wherein the concentric annular grooves comprise independent concentric continuous annular grooves, a template disposed on the bottom surface of the housing, wherein the template is configured to contact the substrate when temporally attached to the template to prevent slippage of the substrate, and an inlet in communication with the grooves for coupling to a pressure medium supply to supply a pressure medium to the grooves, the pressure medium when supplied to the grooves exerts pressure on the template to provide back side pressure on a back surface of the substrate when temporally attached to the template; and polishing the substrate based on the pressure profile.

17. The polishing head in claim 1 comprises stainless steel.

* * * * *